US009423091B2

(12) United States Patent
Reinprecht et al.

(10) Patent No.: US 9,423,091 B2
(45) Date of Patent: Aug. 23, 2016

(54) HEADLIGHT FOR A MOTOR VEHICLE AND METHOD FOR DISTRIBUTING LIGHT

(71) Applicant: ZIZALA LICHTSYSTEME GMBH, Wieselburg (AT)

(72) Inventors: Markus Reinprecht, Wieselburg (AT); Friedrich Bauer, Bergland (AT)

(73) Assignee: ZIZALA LICHTSYSTEME GMBH, Wieselburg (AT)

( * ) Notice: Subject to any disclaimer, the term of this patent is extended or adjusted under 35 U.S.C. 154(b) by 0 days.

(21) Appl. No.: 14/766,313

(22) PCT Filed: Jan. 21, 2014

(86) PCT No.: PCT/AT2014/050020
§ 371 (c)(1),
(2) Date: Aug. 6, 2015

(87) PCT Pub. No.: WO2014/121314
PCT Pub. Date: Aug. 14, 2014

(65) Prior Publication Data

US 2015/0369440 A1 Dec. 24, 2015

(30) Foreign Application Priority Data

Feb. 7, 2013 (AT) ..... 99/2013
Sep. 24, 2013 (AT) ..... 50614/2013

(51) Int. Cl.
*F21V 11/00* (2015.01)
*F21S 8/10* (2006.01)
*F21Y 101/02* (2006.01)

(52) U.S. Cl.
CPC ..... *F21S 48/1757* (2013.01); *F21S 48/1159* (2013.01); *F21S 48/125* (2013.01); *F21S 48/1225* (2013.01); *F21Y 2101/025* (2013.01)

(58) Field of Classification Search
CPC ..... F21S 48/1757; F21S 48/1159; F21S 48/125; F21S 48/1225; F21S 48/11; F21S 48/1127; F21S 48/1145; F21Y 2101/025; B60Q 1/04
USPC ..... 362/459, 464, 465, 466, 507, 543, 544, 362/545, 516, 548, 510, 509, 259
See application file for complete search history.

(56) References Cited

U.S. PATENT DOCUMENTS

2003/0001955 A1* 1/2003 Holz ..... G01S 17/936 348/148

* cited by examiner

*Primary Examiner* — Anh Mai
*Assistant Examiner* — Glenn Zimmerman
(74) *Attorney, Agent, or Firm* — Sutherland Asbill & Brennan LLP

(57) ABSTRACT

A motor vehicle headlight with at least one modulable laser light source (1*a* . . . 1*d*), whose laser beam is directed onto a means of light conversion (8) through a pivoting micromirror (7) controlled by a mirror control (9), and with a projection system (12) to project the light image produced by the means of light conversion onto the road, in which at least two laser light sources (1*a* . . . 1*d*) are provided that have a laser control (3) assigned to them to modulate the beam intensity, optics (5*a* . . . 5*d*) being arranged between each laser light source and the micromirror (7), each forming a laser beam (6*a* . . . 6*d*) with a specified beam cross section, the micromirror oscillating about an axis at a fixed frequency, the formed beams of the at least two laser light sources being reflected through the micromirror to form at least two horizontal light bands (10*a* . . . 10*d*) lying next to one another on the means of light conversion (8).

12 Claims, 2 Drawing Sheets

HEADLIGHT FOR A MOTOR VEHICLE AND METHOD FOR DISTRIBUTING LIGHT

Figure 1:
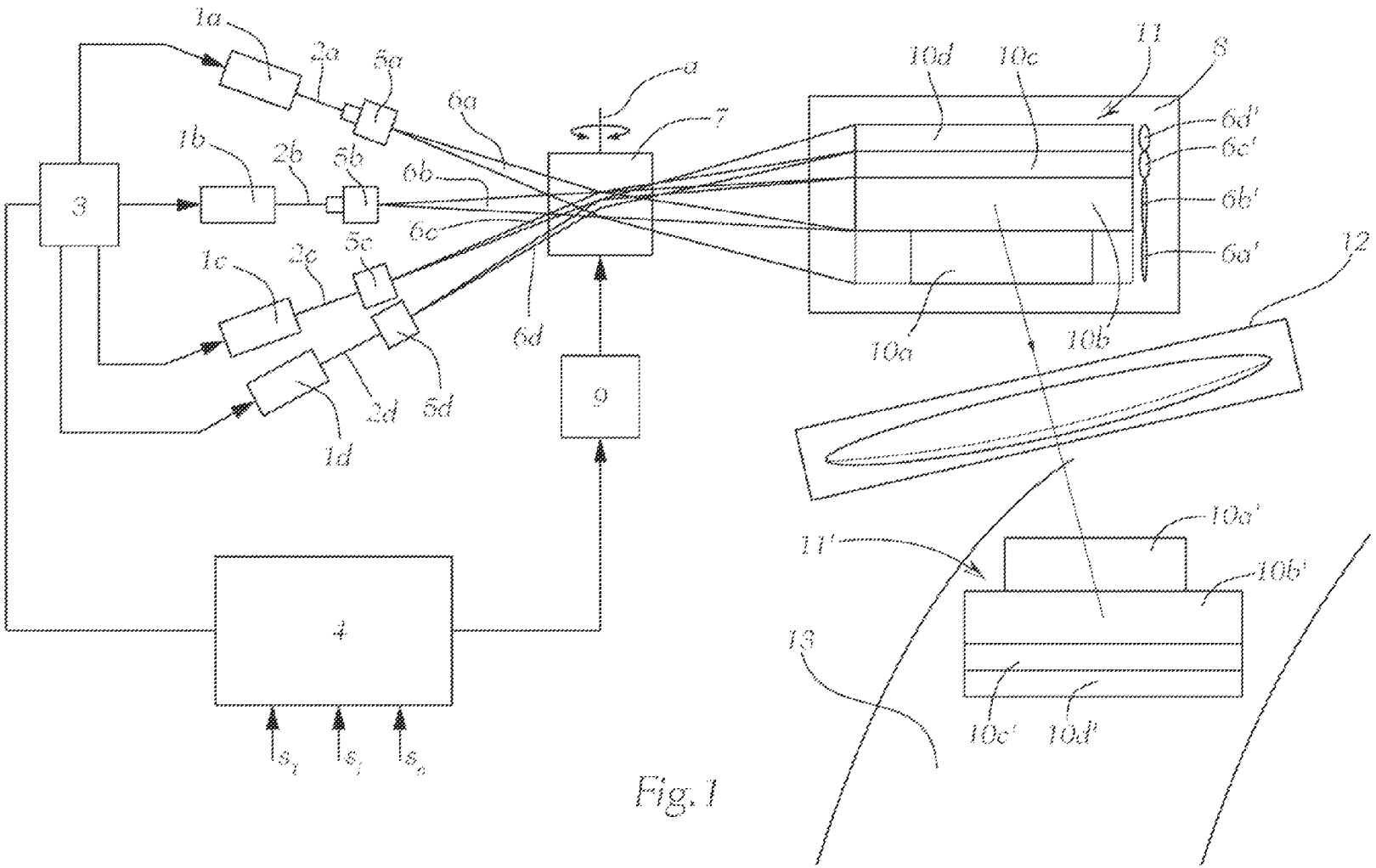

The invention relates to a process for producing a specified light pattern on a road using a motor vehicle headlight, wherein at least one modulated laser beam is directed onto a means of light conversion through a pivoting micromirror, and the light image produced on the means of light conversion is projected onto the road.

The invention also relates to a motor vehicle headlight with at least one modulable laser light source whose laser beam is directed onto a means of light conversion through a pivoting micromirror controlled by a mirror control, and with a projection system to project the light image produced by the means of light conversion onto the road.

The use of laser light sources in motor vehicles is at currently becoming more important, since, e.g., the dimensions of laser diodes are smaller than those of common light-emitting diodes, allowing more flexible and more efficient mounting solutions, and also allowing a substantial increase in the light beam's luminance and the luminous efficiency.

However, the known solutions do not involve the direct emission of a laser beam, to prevent the extremely concentrated high-power light beam from endangering the eyes of humans and other living things. Instead, the laser beam is converted, on an interposed converter that contains a luminescence conversion material, called "phosphor" for short, from, e.g., blue light preferably into "white" light.

EP 2 063 170 A2 discloses a motor vehicle headlight of the type mentioned at the beginning that can, to illuminate the road with a nonglare, adaptive high beam, omit certain areas depending on other road users. The laser beam is directed, through a micromirror that can move in at least two directions in space, onto an emitting surface containing a phosphor to convert the laser light into (preferably) white light. A lens is used to project the emitting surface's light image onto the road. Since the micromirror must deflect a concentric laser beam, it is exposed to a correspondingly high specific load per unit area, which makes its construction more expensive.

DE 10 2008 022 795 A1 discloses a motor vehicle headlight in which the beams of three semiconductor lasers of the colors red, green, and blue are united by an achromatic lens into a white beam that strikes a mirror that oscillates about two axes. A control device modulates the beam power in such a way that specified areas of the mirror are illuminated with specified power. In one embodiment, the mirror can be coated with a converter material. Another embodiment has a controlled micromirror array. In this embodiment, a laser beam strikes a diffuser that is simultaneously a light converter and that illuminates the micromirror array. Projection optics can project the desired image produced by the mirror array onto the road.

Quite generally, it is desired that adaptive headlight systems (AFS=Adaptive Frontlighting Systems) have more functionalities with high resolution and short reaction times. However, the known devices are either very complex or have resolution problems in at least one direction, usually horizontally. This also applies for headlights that use an LED matrix for illumination in which segments of the matrix can be turned on or off. In this case, the most favorable resolution is 1.5°.

A goal of the invention is to create a process or a headlight of the type that is the subject of the invention that has improved resolution in the horizontal direction and meets the above-mentioned requirements on AFS functions, without having a highly complex structure.

This goal is achieved with an inventive process of the type mentioned at the beginning, in which the laser beams of at least two laser light sources with a specified beam cross section are directed, through the micromirror oscillating about an axis, onto the means of light conversion to produce at least two light bands lying next to one another on the means of light conversion.

The functionality of a headlight can be considerably increased if the laser beam of at least one laser light source is fanned out into a beam band.

It is also expedient for the length of the light bands to be adjusted through the oscillation amplitude of the micromirror.

It is especially advantageous for the shape and size of the projections produced on the means of light conversion to be determined by the beam-forming optics and/or the choice of the distance of the emitting surface from the focal points of these optics.

The above-mentioned goal can also be achieved using of a headlight of the type indicated above, in which at least two laser light sources are inventively provided that have a laser control assigned to them to modulate the beam intensity, optics being arranged between each laser light source and the micromirror, each forming a laser beam with a specified beam cross section, the micromirror oscillating about an axis at a fixed frequency, the beams of the at least two laser light sources being reflected through the micromirror to form at least two light bands lying next to one another on the means of light conversion, the distance of the light bands from one another being determined by the angle between the formed laser beams of the at least two laser light sources, the length of the light bands on the means of light conversion being determined by the oscillation amplitude of the micromirror, and the width of the light bands being determined by the beam cross section.

To obtain a light image without interfering dark stripes, it is recommended that the light bands lie directly against one another, with any separation.

It is advantageous for the micromirror to be controlled through the mirror control with its mechanical natural frequency.

An expedient embodiment also allows the horizontal swing amplitude of the micromirror to be changed through the mirror control.

A practical further development of the invention provides that the fanned-out beams of the at least two laser light sources are reflected through the micromirror to form at least two horizontal light bands lying on top of one another on the means of light conversion.

An advantageous variant of this further development is for three laser light sources to be provided to form three light bands lying on top of one another on the emitting surface, it being possible for the light bands of the emitting surface projected onto the road to correspond to high beams, the light/dark boundary, and low beams.

It is advantageous for the light bands to have different heights, in order to increase the vertical resolution in the high beam area, for example.

Figure 1A:
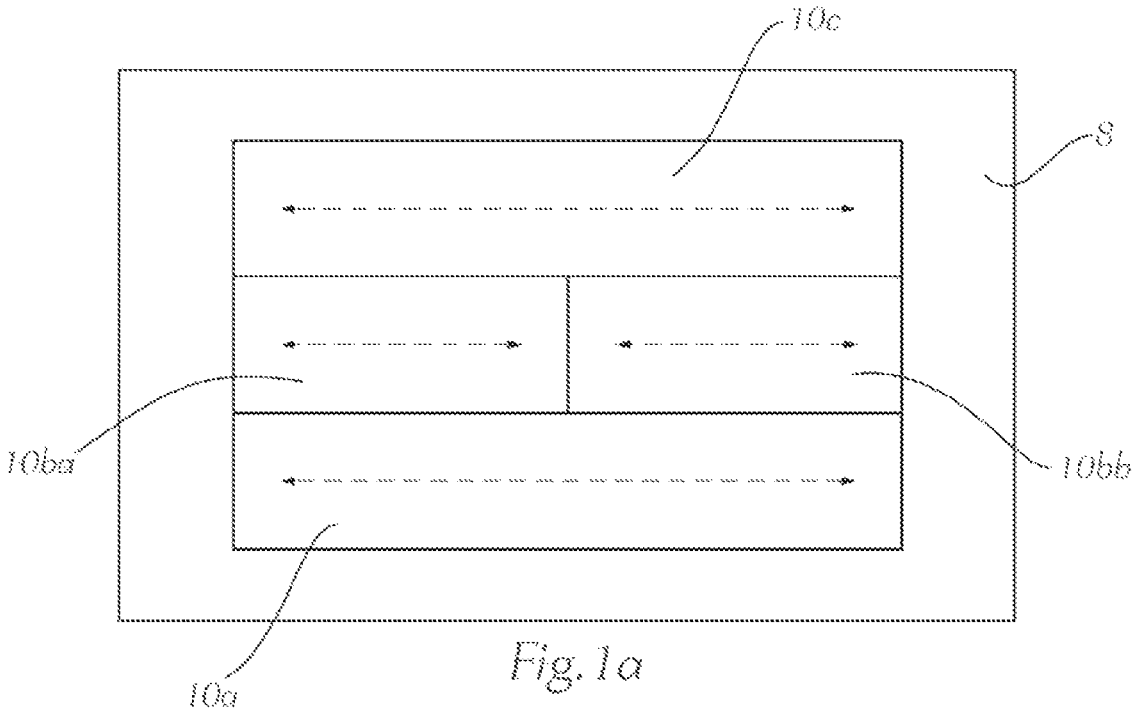

The invention, along with further advantages, is explained in detail below using sample embodiments that are illustrated in the drawing. The figures are as follows:

FIG. 1 schematically shows the components of a headlight that are essential for the invention and their relationship; and FIGS. 1*a* and *b* show other possible ways of illuminating the emitting surface of an inventive headlight.

With reference to FIG. 1, a sample embodiment of the invention is now explained in detail. In particular, it shows the parts that are important for an inventive headlight, it being clear that a motor vehicle headlight also contains many other parts that allow it be used in a meaningful way in a motor vehicle, such as, in particular, a passenger vehicle or motorcycle. From the perspective of illuminating engineering, the starting point of the headlight are four laser light sources 1*a*, 1*b*, 1*c*, and 1*d*, each of which emits a laser beam, designated as 2*a*, 2*b*, 2*c*, and 2*d*, and each of which has a laser control 3 assigned to it, which supplies current and which is also set up to modulate the beam intensity of the individual lasers. In the context of this invention, the term "modulate" is understood to mean that the intensity of a laser light source can be changed, either continuously or in a pulsed manner, in the sense of being turned on or off. It is essential that it be possible for the light output to be dynamically changed in an analogous manner, depending on the angle position of a mirror, which will be described in detail later. In addition, it is also possible to turn the light on and off for a certain time, in order not to illuminate defined places.

As for the laser control 3, it in turn contains signals from a central headlight control 4, to which sensor signals s1 . . . si . . . sn can be fed. On the one hand, these control and sensor signals can be, for example, switching commands to switch from high beams to low beams, or on the other hand signals that are picked up from light sensors, which sense the illumination conditions on the road.

Laser light sources 1*a*, 1*b*, 1*c*, and 1*d* emit blue or UV light, for example, each laser light source having one optical system 5*a*, 5*b*, 5*c*, 5*d* downstream of it, to give the cross sections of the laser beams 2*a*, 2*b*, 2*c*, 2*d* emitted by the laser light sources a desired shape. The optical systems 5*a*, 5*b* are expansion optics, consisting, in particular, of the expansion optics per se, as are known in the field of holography for wide expansion of a laser beam, and, on the other hand, of a light band adapter upstream of the actual expansion optics. Optics for laser beam formation are known and commercially available, for example the LINOS laser optics of the Qioptiq Group, whose delivery program comprises light band adapters for laser expansion optics. After the expansion optics 5*a*, 5*b*, there are fanned-out laser beams 6*a*, 6*b*, whose cross sections are not "punctiform", but rather "linear".

By contrast, the optical systems 5*c*, 5*d* for laser beams 2*c*, 2*d* are common collecting optics or scattering optics, since the laser beams 6*c*, 6*d* after these optics 5*c*, 5*d* are intended to produce "spots" at the points where they impinge, however not "lines".

The formed laser beams 6*a*, 6*b*, 6*c*, 6*d* strike a micromirror 7 and are reflected on means of light conversion 8, in the form of an emitting surface in this example, which has, e.g., a phosphor for light conversion, as is known in the art. The phosphor converts blue or UV light into "white" light, for example. In the context of this invention, the term "phosphor" is quite generally understood to mean a substance or a mixture of substances that converts light of one wavelength into light of another wavelength or of a mixture of wavelengths, in particular, into "white" light, which can be subsumed under the term "wavelength conversion". Here the term "white light" is understood to mean light having a spectral composition that gives humans the impression of a "white" color. Of course the term "light" is not limited to radiation that is visible to the human eye. Possible means of light conversion also include optoceramics, that is, transparent ceramics, such as, for example, YAG-Ce (cerium-doped yttrium aluminum garnet).

The micromirror 7 oscillating only about a single axis is controlled by mirror control 9 and made to oscillate at a constant frequency; these oscillations can correspond especially to the micromirror's mechanical natural frequency. As for the mirror control 9, it is controlled by headlight control 4, to allow adjustment of the oscillation amplitude of micromirror 7, even asymmetric oscillations about the axis a being adjustable. The control of micromirrors is known, and can be done in many ways, e.g., electrostatically or electrodynamically. In tested embodiments of the invention, micromirror 7 oscillates, for example, with a frequency of a few hundred Hz, and its maximum deflection is a few degrees to 60°, depending on its control. It is expedient for feedback about the position of micromirror 7 to be sent to mirror control 9 and/or headlight control 4.

Formed laser beams 6*a*, 6*b*, 6*c*, 6*d* produce, on the means of light conversion 8, namely on the emitting surface 8, which is generally flat, however need not be flat, horizontal light bands 10*d*, 10*c*, 10*b*, 10*a*, the angle of laser light sources 1*a*, 1*b*, 1*c*, 1*d* with respect to micromirror 7 being adjusted in such a way that the light bands lie on top of one another on the emitting surface and border one another, the distance of the light bands from one another preferably being zero. Corresponding adjustment of laser light sources 1*a*, 1*b*, 1*c*, 1*d* can adjust this exactly and produce, on the emitting surface, a light image 11 that is composed of light bands, in this case four light bands 10*a*, 10*b*, 10*c*, and 10*d*. This light image 11 is now projected on the road 13 as light image 11' using a projection system 12. The use of only three laser light sources to form three light bands projected on the road is also possible, for example, since these light bands can then correspond to high beams, the light/dark boundary, and low beams (forward light).

The projections that would be seen if mirror 7 were stationary and that correspond to the respective laser beam cross section at this place are schematically shown to the right of the symbolically shown means of light conversion 8, namely the emitting surface. Laser beams 6*c*, 6*d* produce "spots" 6*d*', 6*c*' as projections, the size of the spots being determined in particular by the position of the emitting surface and of the micromirror 7 with respect to optics 5*c*, 5*d*.

In the drawing, it should also be pointed out that two pairs of light bands, namely 10*a*, 10*b* or 10*c*, 10*d*, are drawn the same height, however that the individual "lines" 6*b*', 6*a*' or 6*d*', 6*c*' are not the same height in practice. For example, the light band for high beams can be "higher" than that for low beams or for the light/dark boundary, whose dimension is the smallest in the height direction. If a change is made in the height of individual light bands, of course the angle of the laser or laser beams to one another must also be changed, to make the distance between the light bands equal to zero again.

Here the term "road" is a simplification, since of course whether image 11' is actually on the road or also extends beyond it depends on the local conditions. In theory, image 11' corresponds to a projection onto a vertical surface according to the relevant standards that relate to motor vehicle illuminating engineering. It should also be clear that the term "horizontal" should be understood in a relative meaning here, and relates to a level road or to a normal position of the vehicle. In theory, light bands 10*a*', 10*b*', and 10*c*' of the image 11' projected onto the road 13 should be essentially horizontal but not necessarily [completely] horizontal, which goes all the more for light bands 10*a*, 10*b*, 10*c* on emitting surface 8.

It is now apparent that light image 11, and thus also road illumination 11' can, on the one hand, be changed by adjusting the oscillation amplitude of micromirror 7, which changes the length of horizontal light bands 10*a*, 10*b*, 10*c*, 10*d* and that the intensity distribution within each light band can also be changed by adjusting the intensity of the individual laser light sources 1*a*, 1*b*, 1*c*, 1*d*. In addition, it should be noted that it is possible to control high-frequency laser light sources, whether pulsed or with continuous intensity modulation, so that any light patterns within the light bands, which correspond to the respective position of the micromirror 7, are not only adjustable but rather also rapidly changeable, if a special terrain or driving situation requires this, for example, if oncoming vehicles or pedestrians are picked up by sensors and a corresponding change is desired in the geometry and/or intensity [of] road illumination 11' in accordance with this.

Figure 1B:
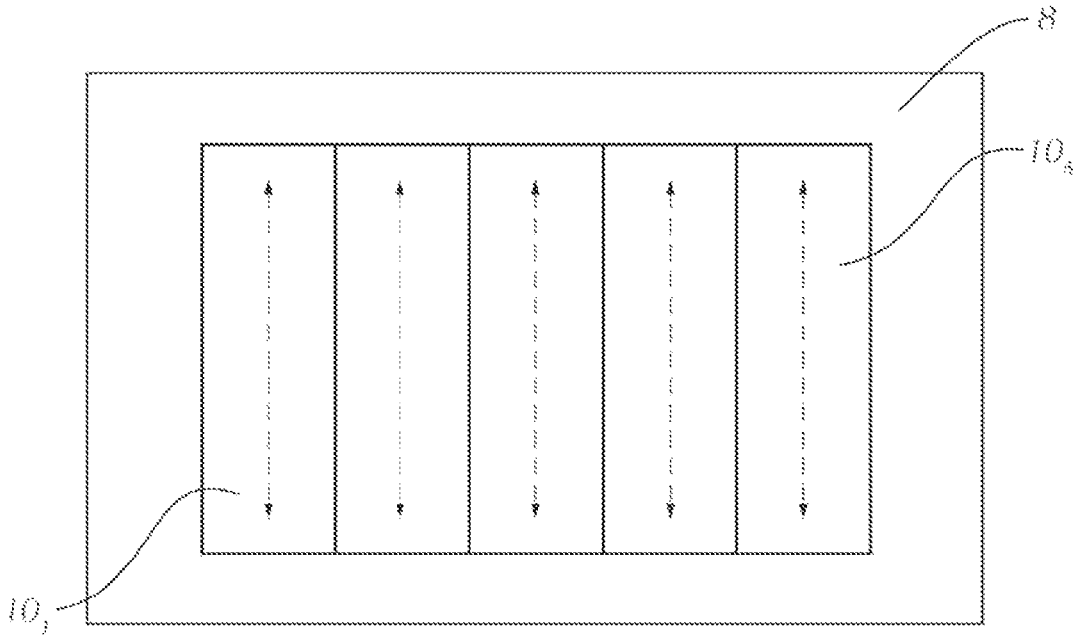

FIG. 1*a* and FIG. 1*b* schematically show other possible ways of controlling or illuminating emitting surface 8 with four or five fanned-out laser beams. FIG. 1*a* shows how the middle horizontal light band can be divided into two light bands 10*ba* and 10*bb* lying next to one another, resulting in light bands that lie on top of one another and next to one another. Here, for example, the low beams would be formed from two lines of two light sources.

On the other hand, it is also possible, as illustrated in FIG. 1*b*, to put together the light image from light bands 101 . . . 105 lying next to one another, if the mirror 7 oscillates in the corresponding way.

To project targeted points or lines, whose horizontal extension can be controlled, the laser light sources can be controlled in a pulsed manner as a function of the current position of the mirror. For example, to have light exit from the optical system only from 0° to 10°, the corresponding laser is turned off when the angular position of the micromirror corresponds to this range, and thus light is only radiated in the range from 0° to 10°.

In comparison with conventional AFS systems, the inventive process and headlight offer the advantage of allowing a very high, theoretically infinite horizontal resolution, since the light source can effectively be turned on at every point in time by analogous oscillation of the micromirror. In addition, the sharp delimitation of the cut out area of an illuminated object results in small scattered light values, which allows very good display of this area.

The result is that the mirror and laser control is a noticeably less complex than that of known solutions, in which a micromirror oscillates about two axes. The reason why is that the known solutions require mirror oscillation frequencies of about 250 Hz on the X-axis and about 10 kHz on the Y-axis to produce an image that is flicker-free for the eye. If it is assumed that a resolution of 200 pixels is necessary in practice, this requires laser pulse rates of up to 2 MHz, which can cause considerable difficulties with respect to the system's electromagnetic compatibility, and also the development of line lengths and cable routing that are expensive because these are high frequency lines.

The invention claimed is:

1. A process for producing a specified light pattern on a road using a motor vehicle headlight, comprising:

directing at least one modulated laser beam onto a means of light conversion through a pivoting micromirror, and projecting a light image produced on the means of light conversion onto the road, wherein laser beams of at least two laser light sources with a specified beam cross section are directed, through the micromirror oscillating about an axis, onto the means of light conversion to produce at least two light bands lying next to one another on the means of light conversion.

2. The process described in claim 1, wherein the laser beam of at least one laser light source is fanned out into a beam band.

3. The process described in claim 1, wherein a distance of the at least two light bands from one another is determined by an angle between the laser beams of the at least two laser light sources and/or by an oscillation amplitude of the micromirror.

4. The process described in claim 1, wherein a shape and size of projections produced on an emitting surface are determined by beam-forming optics and/or a distance of the means of light conversion from focal points of the beam-forming optics.

5. The process described in claim 3, wherein a length of the at least two light bands is adjusted through the oscillation amplitude of the micromirror.

6. A motor vehicle headlight, comprising:

at least one modulable laser light source, whose laser beam is directed onto a means of light conversion through a pivoting micromirror controlled by a mirror control, a projection system to project a light image produced by the means of light conversion onto a road, and at least two laser light sources, which have a laser control assigned to them to modulate a beam intensity, wherein each laser light source and the micromirror includes optics arranged between them, each forming a laser beam with a specified beam cross section, wherein the micromirror oscillates about an axis at a fixed frequency, the beams of the at least two laser light sources being reflected through the micromirror to form at least two light bands lying next to one another on the means of light conversion, wherein a distance of the light bands from one another is determined by an angle between the formed laser beams of the at least two laser light sources, a length of the light bands on the means of light conversion being determined by an oscillation amplitude of the micromirror, and width of the light bands being determined by a beam cross section.

7. The headlight described in claim 6, wherein the light bands lie directly against one another, without any separation.

8. The headlight described in claim 6, wherein the micromirror is controlled through the mirror control with its mechanical natural frequency.

9. The headlight described in claim 6, wherein a horizontal swing amplitude of the micromirror can be changed through the mirror control.

10. The headlight described in claim 6, wherein the beams of the at least two laser light sources are reflected through the micromirror to form at least two horizontal light bands lying on top of one another on the means of light conversion.

11. The headlight described in claim 10, wherein three laser light sources form three light bands lying on top of one another on the means of light conversion, the light bands of an emitting surface projected onto the road corresponding to high beams, the light/dark boundary, and low beams.

12. The headlight described in claim 11, wherein the light bands have different heights.

* * * * *